US006505631B2

(12) United States Patent
Fischer et al.

(10) Patent No.: US 6,505,631 B2
(45) Date of Patent: Jan. 14, 2003

(54) APPLICATOR ASSEMBLY FOR COSMETIC LIQUIDS IN PARTICULAR MASCARA TESTER

(75) Inventors: Werner Fischer, Burk (DE); Norbert Dumler, Ansbach (DE)

(73) Assignee: Geka Brush GmbH, Bechhofen (DE)

( * ) Notice: Subject to any disclaimer, the term of this patent is extended or adjusted under 35 U.S.C. 154(b) by 0 days.

(21) Appl. No.: 09/884,156

(22) Filed: Jun. 20, 2001

(65) Prior Publication Data

US 2001/0052348 A1 Dec. 20, 2001

(30) Foreign Application Priority Data

Jun. 20, 2000 (DE) ..... 100 29 378

(51) Int. Cl.[7] ..... A45D 40/26; A45D 40/24; A46B 11/00

(52) U.S. Cl. ..... 132/218; 132/318; 132/320; 401/127; 401/122; 401/129

(58) Field of Search ..... 132/218, 320, 132/317, 313, 318; 401/127, 122, 129, 126

(56) References Cited

U.S. PATENT DOCUMENTS

| | | | | | |
|---|---|---|---|---|---|
| 4,886,387 | A | * | 12/1989 | Goldberg et al. | 401/122 |
| 5,180,241 | A | * | 1/1993 | Gueret | 401/122 |
| 5,190,389 | A | * | 3/1993 | Vasas | 401/122 |
| 5,556,214 | A | * | 9/1996 | Ascolese | 401/126 |
| 5,791,800 | A | * | 8/1998 | Katz | 401/122 |
| 6,082,918 | A | * | 7/2000 | Gueret | 401/126 |
| 6,082,999 | A | * | 7/2000 | Tcherny et al. | 433/80 |
| 6,237,609 | B1 | * | 5/2001 | Vasas | 132/218 |
| 6,270,273 | B1 | * | 8/2001 | Ohba | 401/122 |

* cited by examiner

*Primary Examiner*—John J. Wilson
*Assistant Examiner*—Robyn Kieu Doan
(74) *Attorney, Agent, or Firm*—Browdy and Neimark, P.L.L.C.

(57) ABSTRACT

An applicator assembly for cosmetic liquids, in particular a mascara tester, is provided with a container for holding the cosmetic liquid, a closure cap for the container and a wiper for the cosmetic liquid, which lodges in the neck of the container. In an intermediate stage of manufacture of the applicator assembly, the wiper is detachably mounted on the closure cap. In a subsequent stage of manufacture, upon insertion of the closure cap into the container neck, the wiper is durably fixed there.

10 Claims, 3 Drawing Sheets

APPLICATOR ASSEMBLY FOR COSMETIC LIQUIDS IN PARTICULAR MASCARA TESTER

BACKGROUND OF THE INVENTION

1. Field of the Invention

The invention relates to an applicator assembly for cosmetic liquids, in particular to a mascara tester, comprising

- a container for holding the cosmetic liquid, which has a main body and a neck;
- a closure cap, which is detachably insertable into the neck and comprises
  - a handle member for handling the applicator assembly, which stays outside the neck,
  - a closing member for closing the container, which is insertable into the neck, and
  - an applicator holder to be positioned in the container;
- an applicator for the cosmetic liquid, which is disposed on the applicator holder, in particular a mascara brush; and
- a wiper for the cosmetic liquid, which lodges in the neck of the container.

2. Background Art

As everybody knows, applicator assemblies of the generic type comprise a container that holds the cosmetic liquid. The liquid is in the main body of the container. A neck on the container serves for the accommodation and mounting of a detachable closure cap, which can be tightly inserted therein and comprises a handle member that remains outside the neck for the applicator assembly to be handled, a closing member that can be inserted into the neck and serves for closing the container and a holder for the applicator which can be positioned in the container. An applicator for the respective cosmetic liquid and in particular a mascara brush is disposed on the holder. The applicator assembly according to the invention may however also be used for liquid lip gloss, eye shadow, eye liner, nail varnish and the like. The applicator is suited to the respective purpose.

Finally, applicator assemblies of the species have a wiper for the cosmetic liquid, which is disposed in the neck of the container and, as a rule, has an orifice for the applicator to pass through, the inside diameter of this orifice being smaller than the outside diameter of the applicator. Thus any excess cosmetic liquid is stripped off when the applicator is withdrawn from the container, dropping back into the container.

There is the fundamental requirement to have applicator assemblies which, as far as possible, can be filled and then closed automatically. The filling and closing job is desired to take place in as short a time as possible.

In this context, the wiper and its narrow orifice pose a problem, because the cross-sectional area of the jet of filling compound and thus the filling rate are strongly restricted.

SUMMARY OF THE INVENTION

It is an object of the invention to improve an applicator assembly for cosmetic liquids so that the processes of filling, of mounting the wiper and of closing the filled container can be strongly rationalized and may in particular take place rapidly on automatic fillers.

This demands for a special design and manipulation of the wiper. The invention is reflected by a mixture of features in terms of apparatus and manufacturing engineering. For instance, in an intermediate stage of manufacture of the applicator assembly, the wiper is detachably mounted on the closure cap. In a subsequent stage of manufacture, when the closure cap is inserted into the neck of the filled container, the wiper is durably fixed in the neck of the container. This sequence implies that the container is first filled over the full cross-sectional area of the neck and then the wiper is fixed in the neck. This sequence is preferably ensured by the fact that on the one hand the wiper is fixed by press-fit on the closure cap and that on the other hand the wiper is provided outside with a locking projection, it being possible to engage the locking projection with a locking recess on the inside of the container neck for the wiper to be fixed. The design of the press-fit and locking engagement must respect that the locking force is greater than the force of press-fit disengagement. This ensures that the wiper is fixed when first inserted into the container neck, and that it stays where it is in the neck when the closure cap is removed for the first time.

The stop construction preferably put into practice for the wiper and the neck aids in the fixing of the wiper in the container.

Furthermore, the closure cap is fixable in its closed position on the container by corresponding locking engagement. In this regard, closing the cap is accompanied with very simple handling, which can very well be put into practice mechanically. The optional provision of a serrated or wave pattern on the edge of the container neck and of a corresponding counterpart pattern of serrations or waves on the closure cap enables the consumer to open the cap conventionally by rotation. This also helps in a gentle opening of the applicator assembly.

The preferred embodiment of the handle member as a hollow handle that is open counter to the direction of insertion, having in particular a plane ring surface that encircles the opening of the handle member, serves for further improvement of the possibility of automatic mounting of the applicator assembly. Corresponding handling elements may reach into the opening of the handle member and provide for proper vertical press-fit of the cap in the container neck.

Further features, details and advantages of the invention will become apparent from the ensuing description of an exemplary embodiment of the subject matter of the invention, taken in conjunction with the drawings.

DESCRIPTION OF THE PREFERRED EMBODIMENT

Figure 1:
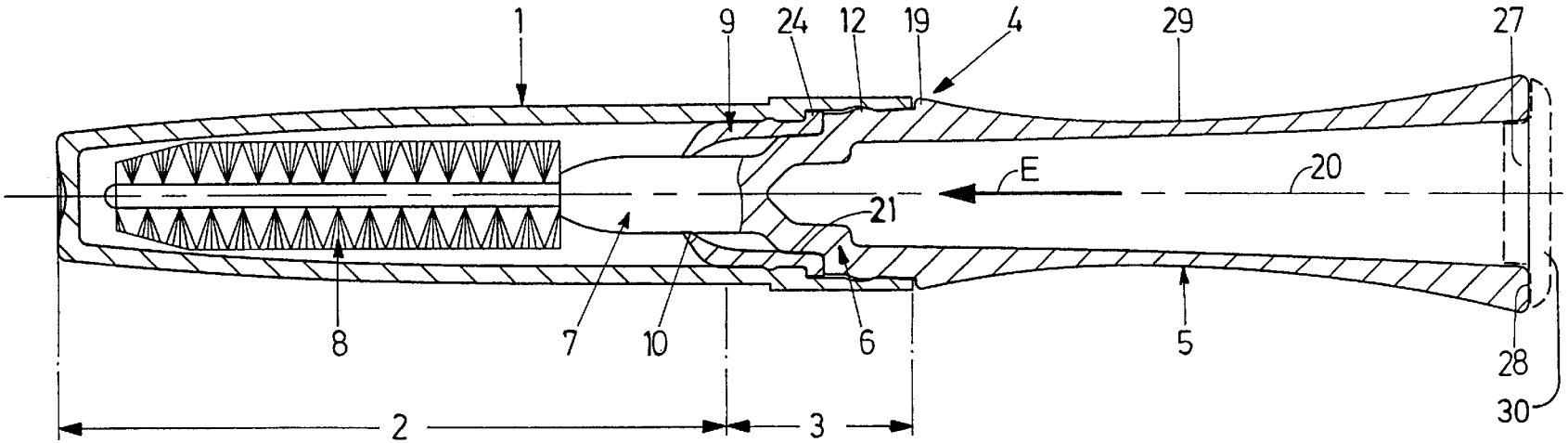
FIG. 1 is an axial sectional view of a mascara tester in the closed position of the closure cap.

FIG. 1 illustrates the main components of a test applicator for mascara. A substantially elongated cylindrical container 1 is provided. The main body 2 of this container 1 holds the mascara (not shown). A neck 3 is placed on the opening of the main body 2, forming a single piece therewith; a closure cap, which is designated by 4 in its entirety, is detachably insertable into the neck 3. The closure cap 4 consists of a handle member 5, which remains outside the neck; a closing member 6, which can be inserted and anchored in the container neck 3, closing the container 1; and a shank 7 to be positioned in the container, serving for the mounting of the virtual applicator in the form of a mascara brush 8. When the container 1 is filled and closed, the mascara brush 8 dips into mascara.

In order for excess liquid to be removed that adheres to the brush 8 when it is withdrawn from the container 1, provision is made for a stripping device 9—a so-called "wiper"—which is located between the shank 7 of the closure cap 4 and the neck 3 of the container 1. This wiper 9 is a substantially annular insert, which tapers in the direction of insertion E of the closure cap 4 and is equipped with a centrical orifice 10 for the mascara brush 8 and the shank 7. The inside diameter of the orifice 10 is smaller than the outside diameter of the mascara brush 8 so that the mentioned mascara stripping effect is attained upon withdrawal of the brush 8.

For the closure cap 4 to be fixed in the container neck 3, an encircling annular locking projection 12 is provided on the outer jacket 11 of the closing member 6 (FIG. 2), cooperating with an encircling annular locking-recess 13 in the form of a complementary groove on the inside 14 of the container neck. Upon insertion of the closure cap 4 into the container neck 3, the locking projection 12 and the locking recess 13 engage with each other, which ensures the container 1 to be safely mounted and tightly closed.

Figure 2:
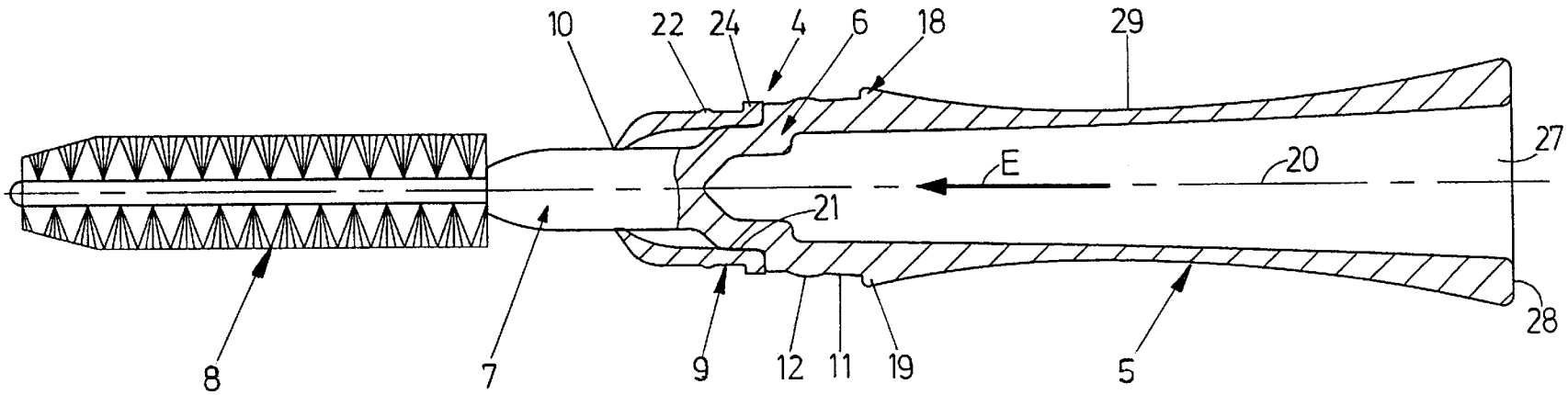
FIG. 2 is an axial sectional view of the closure cap with a wiper disposed thereon in an intermediate stage of manufacture.
Figure 3:
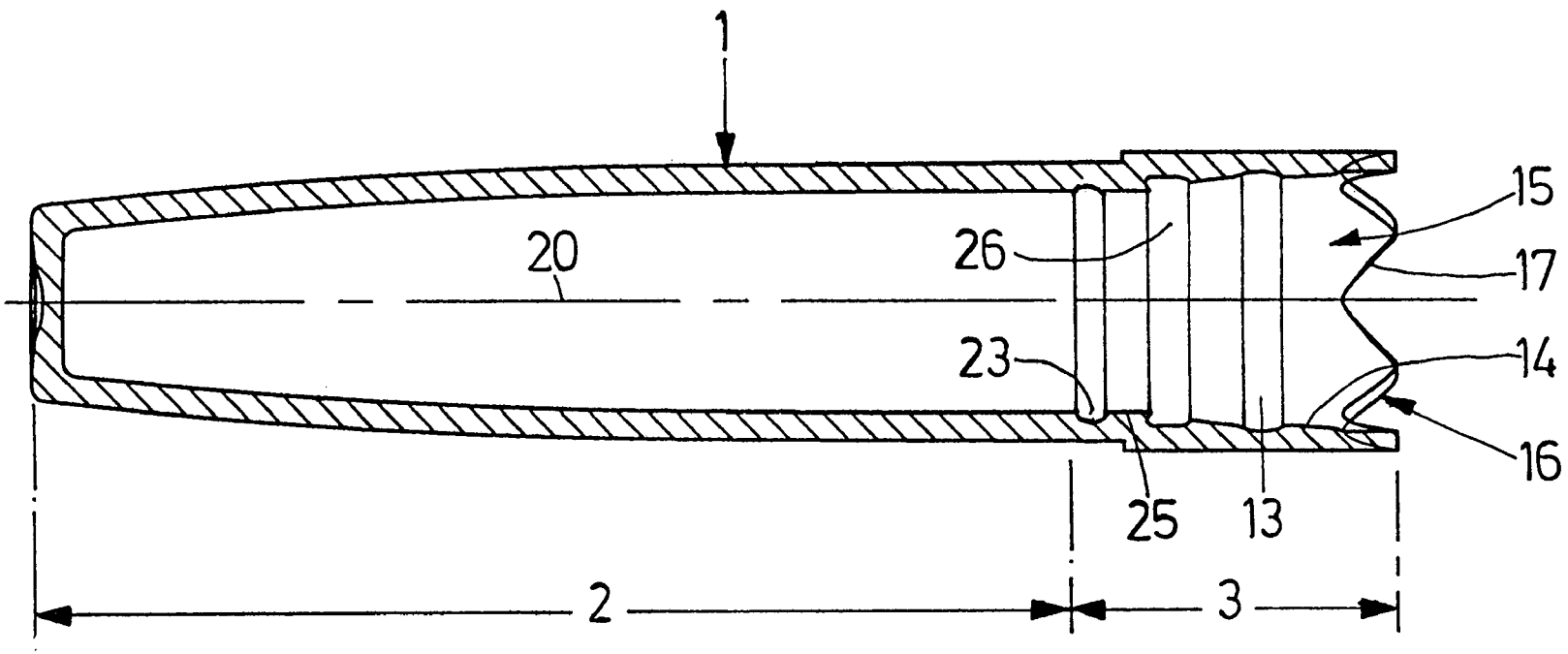
FIG. 3 is an axial sectional view of the container of the mascara tester prior to the insertion of the wiper.

As seen in particular in FIG. 3, the edge 16 which encircles the insertion hole 15 of the neck is designed as a peripherally encircling, more or less serrated wave pattern 17, which cooperates with a complementarily serrated counterpart wave pattern 18 on the end, on the side of the container, of the handle member.S of the closure cap 4. The counterpart pattern 18 is roughly outlined by the noses 19 seen in a section in FIG. 2. The wave pattern 17 and the counterpart pattern 18 may be simplified to such an extent that only a slope and a counterpart slope will remain.

In the position of interlocking of the locking projection 12 and the locking recess 13, the wave pattern 17 and the counterpart wave pattern 18 rest within each other so that, upon rotation of the closure cap 14 about its axis of rotation 20, the counterpart pattern 18 is lifted from the wave pattern 17, which releases the interlocking. Opening the closure cap 4 takes place conveniently by rotation as the consumer is used to.

Another special feature of the mascara tester resides in the attachment and mounting of the wiper 9. In the intermediate stage of manufacture seen in FIG. 2, the wiper 9 is placed by gentle press-fit, and thus fixed, on an annular shoulder 21 of the closing member 6. The shank 7 for the mascara brush 8 reaches through the orifice 10. An annularly encircling locking projection 22 is provided outside on the wiper 9 approximately centrally of the longitudinal extension thereof and cooperates with a corresponding encircling locking recess 23 on the inside 14 of the container neck 3. In the direction of insertion E, this locking recess 23 is located further inwards than the mentioned locking recess 13 that cooperates with the locking projection 12 of the closure cap 4.

On the edge of the wiper 9 that is turned away from the orifice 10—i.e. after the locking projection 22 in the direction of insertion E—an encircling annular stop projection 24 that sticks out is molded on in a single piece, cooperating with an annular stop shoulder 25 on the container neck 3. Counter to the direction of insertion E, the annular stop shoulder 25 is preceded by a flat, annularly encircling rear recess 26, which ensures additional locking engagement of the wiper 9 via the annular stop projection 24.

As seen from the illustration of the handle member 5 of FIGS. 1 and 2, the handle member 5 has a concave shape externally, which gives a recessed grip 29 and is especially handy. The handle member 5 is hollow virtually over its entire length and open counter to the direction of insertion E. This opening 27 of the handle member 5 is encircled by a plane ring surface 28 so that the handle member 5 can be seized and manipulated in a defined way by means of a handling tool of an automatic assembly machine. Afterwards, the opening may be closed by a cap 30 (roughly outlined by dashes in FIG. 1).

The process of mounting, filling and closing takes place mechanically by the closure cap 4 and the wiper 9 being pre-assembled as the unit seen in FIG. 2 and then supplied to the course of manufacture. The container 1 is filled in the completely opened condition via the neck 3 which, as seen in FIG. 3, has no constriction. Then the automatic handling machine presses the unit formed by the closure cap 4 and the wiper 9—mascara brush 8 first—in the direction of insertion E into the container 1. The locking projection 22 of the wiper 9 engages with the corresponding locking recess 23 on the container neck 3, fixing the wiper 9. The locking projection 12 on the closing member 6 engages with the corresponding locking recess 13 on the container neck 3, as a result of which the closure cap 4 is reliably retained on the container 1.

When the mascara tester is opened for the first time, the press-fit of the wiper 9 on the closing member 6 is released as the closure cap 4 is withdrawn and the wiper 9 retained in the container 1 by the interlocking 22/23.

For the sake of completeness, it must be added that the container 1, the closure cap 4 and the wiper 9 may consist of customary plastic materials such as PP, PE, PET, PVC or PA. As for the design of the handle member 5, various cross-sectional shapes are conceivable; but, given the concavely recessed grip 29, a round cross-sectional shape must be preferred for ergonomic reasons.

What is claimed is:

1. A method of mounting an applicator assembly for cosmetic liquid in a mascara tester, comprising the steps of:

providing a container (1) for holding the cosmetic liquid comprising a main body (1) having a neck (3), and a closure cap (4) comprising a handle member (5), a closing member (6) on the handle member (5) and a mascara applicator (8) engaged on an applicator holder (7) which projects out from the closing member (5), thereafter, in an intermediate stage of manufacture, detachably seating a wiper (9) on the closing member (6), and then, in a subsequent stage of manufacture, inserting the closing member (6) into the neck (3) so as to fix the wiper (9) in the neck (3);

wherein the wiper (9) remains fixed in the neck (3) when the closure cap (4) is later disengaged from the container (1) and the mascara applicator (8) is withdrawn through the wiper (9).

2. A The method according to claim 1, wherein the wiper (9) and the neck (3) have corresponding fastening means to fix the wiper (9) in the neck (3) when in the subsequent stage of manufacture, the closing member (6) is inserted into the neck (3).

3. The method according to claim 2, wherein the corresponding fastening means is an annular projection and a corresponding annular groove.

4. The method according to claim 1, wherein the wiper (9) is press-fitted on the closing member (6) in the intermediate stage of manufacture.

5. The method according to claim 1, wherein the wiper (9) is provided on an outside circumference with a locking projection (22), which engages with a locking recess (23) on an inside circumference (14) of the neck (3) in the subsequent stage of manufacture.

6. The method according to claim 5, wherein the wiper (9) is provided on outside circumference with an annular stop projection (24), after the locking projection (22) in a direction of insertion (E) which cooperates with an annular stop shoulder (25) of the neck (3) in the subsequent stage of manufacture.

7. The method according to claim 1, wherein the closing member (6) of the closure cap (4) is provided on an outer jacket (1) with a locking projection (12), which cooperates with a corresponding locking recess (13) on the neck (3) to fix the closure cap (4) in the container (1).

8. The method according to claim 1, wherein an edge (16) of the neck (3) has a peripherally encircling pattern of waves or serrations (17), which has at least one slope and which engages with a corresponding pattern of waves or serrations (18) on the closure cap (4) in the closed position thereof such that, by rotation of the closure cap (4) relative to the container (1), the closure cap (4) is detachable therefrom, and that in a locking engagement of the closure cap (4) with the container neck (3) is releasable.

9. The method according to claim 1, wherein the handle member (5) is hollow and open counter to a direction of insertion (E).

10. The method according to claim 9, wherein the opening (27) of the handle member (5) is encircled by an at least partially plane ring surface (28).

* * * * *